United States Patent [19]

Evrard et al.

[11] Patent Number: 4,729,316

[45] Date of Patent: Mar. 8, 1988

[54] PROJECTILE CONTAINING A PYROTECHNIC CHARGE AND MEANS FOR DELAYED INITIATION OF THE CHARGE

[75] Inventors: Daniel R. J. Evrard, Toulouse; Hubert Calmettes, Villeneuve Tolosane; Noel Robert, Muret, all of France

[73] Assignee: Etienne Lacroix tous Artifices S.A., Muret, France

[21] Appl. No.: 947,378

[22] Filed: Dec. 29, 1986

[30] Foreign Application Priority Data

Dec. 27, 1985 [FR] France ..... 85 19323

[51] Int. Cl.[4] ..... F42B 4/26; F42C 15/34

[52] U.S. Cl. ..... 102/255; 102/248; 102/257; 102/268; 102/338

[58] Field of Search ..... 102/334, 336, 338–340, 102/342, 345–347, 357, 231–238, 247–249, 254–259, 265–271, 277.1; 89/1.51, 1.57

[56] References Cited

U.S. PATENT DOCUMENTS

| | | | |
|---|---|---|---|
| 1,090,007 | 3/1914 | Ziegenfoss | 102/339 X |
| 2,960,037 | 11/1960 | Raech et al. | 102/251 |
| 3,119,336 | 1/1964 | Hjelm | 102/269 X |
| 3,326,132 | 6/1967 | Tlam | 102/236 |
| 3,451,306 | 6/1969 | Lagerstrom et al. | 89/1.51 X |
| 3,633,510 | 1/1972 | Bernardin | 102/265 X |
| 3,636,880 | 1/1972 | Aske | 102/236 |
| 3,763,785 | 10/1973 | Briggs et al. | 102/258 X |
| 3,982,487 | 9/1976 | Richelle et al. | 102/277.1 |

FOREIGN PATENT DOCUMENTS

| | | |
|---|---|---|
| 1017505 | 12/1952 | France . |
| 2070544 | 9/1971 | France . |
| 2091122 | 1/1972 | France . |
| 2130814 | 11/1972 | France . |
| 2280878 | 2/1976 | France . |
| 1534134 | 11/1978 | United Kingdom . |

*Primary Examiner*—David H. Brown

*Attorney, Agent, or Firm*—Fleit, Jacobson, Cohn & Price

[57] ABSTRACT

A projectile comprises a pyrotechnic charge and a mobile member inside the projectile which rotates between a safe position and an armed position. At least part of a pyrotechnic delay device is accommodated in a passage in this mobile member. The pyrotechnic charge is initiated via this pyrotechnic delay device. The passage is oriented so as to isolate functionally the pyrotechic delay device from the pyrotechnic charge when the mobile member is in the safe position. It functionally couples the pyrotechnic delay device to the pyrotechnic charge when the mobile member is in the armed position. The projectile further comprises an arrangement on the mobile member and on the projectile to guide relative rotation between them about an axis fixed relative to the mobile member and relative to the projectile. A mechanical arming device retains the mobile member in the safe position and against rotation about the aforementioned axis relative to the projectile at least until the projectile is fired. It obliges the mobile member to move to the armed position when the projectile is fired by rotating about the axis relative to the projectile.

17 Claims, 3 Drawing Figures

PROJECTILE CONTAINING A PYROTECHNIC CHARGE AND MEANS FOR DELAYED INITIATION OF THE CHARGE

BACKGROUND OF THE INVENTION

1. Field of the Invention

The present invention concerns a projectile of the type comprising a pyrotechnic charge, a mobile member in said projectile adapted to rotate between a safe position and an armed position, a passage in said mobile member, a pyrotechnic delay device at least part of which is accommodated in said passage and means for initiating said pyrotechnic charge via said pyrotechnic delay device, said passage being oriented so as to isolate said pyrotechnic delay device from said pyrotechnic charge when said mobile member is in said safe position and to link said pyrotechnic delay device to said pyrotechnic charge when said mobile member is in said armed position.

2. Description of the Prior Art

Use is frequently made in the prior art of a spherical rotor as the rotatable mobile member, disposed to rotate freely about a specific center in a spherical bearing of the projectile, and the aforementioned passage is formed along a diameter of the sphere; mechanical means entailing pins, for example, hold the rotor in the safe position, in which the passage is offset angularly relative to other parts of the pyrotechnic system and the movement to the armed position after the projectile is fired requires gyration of the rotor about a longitudinal axis defining the firing direction, on the one hand to release the rotor so that it can rotate relative to the projectile and on the other hand to then cause nutation of the rotor inside the projectile until, because of a ballast weight appropriately positioned within the rotor, the rotor moves to the armed position.

These known arrangements have the disadvantage of requiring gyration of the projectile for the mobile member, that is to say the rotor, to reach the armed position; in other words, such provisions are of limited application in the case of projectiles fired in a guided way from a rifled barrel, while application to projectiles fired by ejecting them from a tube, for example, as is the case with flare type projectiles and chaff launcher projectiles in particular, is out of the question.

Also, friction that may arise between the rotor and its bearing have a decisive influence on the time that elapses between the rotor being released and its reaching the armed position, and the problem of controlling accurately such friction leads to considerably inaccuracy in timing, that is to say in the distance covered by the projectile from the launch device by the time the rotor reaches the armed position; this inaccuracy is unacceptable in the case of projectiles with a pyrotechnic charge that has to be initiated at a comparatively short distance from the launching personnel and device because, in practise, it may be necessary to choose to initiate the pyrotechnic charge at a distance from the launching personnel and device that is of the same order of magnitude as the inaccuracy resulting from the lack of control over the time taken for the rotor to reach the armed position.

In certain cases the rotor constituting the rotatable mobile member may even become immobilized relative to the projectile in a position that does not correspond exactly with the armed position, which can impede the functioning of the pyrotechnic system to the point of even preventing initiation of the pyrotechnic charge.

An objective of the present invention is to alleviate these disadvantages.

SUMMARY OF THE INVENTION

The present invention consists in a projectile comprising a pyrotechnic charge, a mobile member in said projectile adapted to rotate between a safe position and an armed position, a passage in said mobile member, a pyrotechnic delay device at least part of which is accommodated in said passage and means for initiating said pyrotechnic charge via said pyrotechnic delay device, said passage being oriented so as to isolate functionally said pyrotechnic delay device from said pyrotechnic charge when said mobile member is in said safe position and to couple functionally said pyrotechnic delay device to said pyrotechnic charge when said mobile member is in said armed position, said projectile further comprising means on said mobile member and on said projectile to guide relative rotation between them about an axis fired relative to said mobile member and relative to said projectile and mechanical arming means adapted to retain said mobile member in said safe position and against rotation about said axis relative to said projectile at least until said projectile is fired and to oblige said mobile member to move to said armed position when said projectile is fired by rotating about said axis relative to said projectile.

Said mechanical arming means advantageously comprise delay means adapted to delay movement of said mobile member to said armed position relative to firing of said projectile.

Guiding the mobile member to rotate about a defined axis fixed relative to the member and relative to the projectile makes it possible to use, for bringing about the movement to the armed position, mechanical means featuring increased reliability in terms of the time to move from the safe position to the armed position and in terms of the accuracy of the actual armed position in comparison with a required armed position so that, in particular, the arrangement characteristic of the invention can be adopted even where the pyrotechnic charge has to be initiated after the projectile has travelled a relatively short distance away from the launching personnel and device, given that the movement to the armed position has to occur before initiation of the pyrotechnic charge under normal conditions of functioning.

Those skilled in the art will readily understand that the passage from the safe position to the armed position is in no way dependent on any gyration of the projectile when the arrangement characteristic of the invention is adopted, which makes it possible to adopt this arrangement universally, whether the projectile is designed to be fired from a rifled barrel or otherwise.

It will also be noted that the fact that the mobile member inside the projectile is guided to rotate about a precisely defined axis means that the passage can be other than straight, for example right-angled in an L- or T-shape, with it being certain that in the armed position each end of the passage is aligned with the necessary other parts of the pyrotechnic system.

This makes it possible, for example, for the passage to have a first branch disposed along said axis and a second branch disposed substantially perpendicularly to said axis, the first branch being functionally coupled to fuse means and the second branch being functionally coupled to the pyrotechnic charge in the armed position and functionally isolated from the pyrotechnic charge in the safe position; in a case such as this the pyrotechnic charge may comprise two operational charges in diametrally opposite positions relative to said axis, the second branch of the passage passing through said member perpendicularly to said axis, perpendicularly to the diametral alignment of the two operational charges in the safe position or parallel to this alignment in the armed position.

This procures general design principles for projectiles that are not available when the mobile member in the projectile is, in the known way, in the form of a rotor that moves to the armed position by a nutation, as the passage in a rotor of this kind has of neccessity to be disposed along a diameter thereof, without any possibility of bends or branches since the nutation of the rotor would rule out correct positioning of the various ends of the channel at the same time relative to other parts of the pyrotechic system in a case such as this.

Other characteristics and advantages of the invention will emerge from the following description of one embodiment given by way of non-limiting example only and with reference to the appended drawings which form an integral part of the description; in this embodiment the projectile in accordance with the invention is associated with a longitudinal tube, to form a cartridge, and the projectile is fired by ejecting it from the tube, in an ejection direction determining the firing direction; nevertheless, those skilled in the art will easily understand that the symmetry characteristic of the invention could equally well be adopted in the case of projectiles designed to be launched by other means, for example by sliding along a barrel or along a launching ramp; such adaptation of the arrangements that will now be described with reference to a cartridge lie within the normal competence of those skilled in the art.

DESCRIPTION OF THE PREFERRED EMBODIMENT

Figure 1:
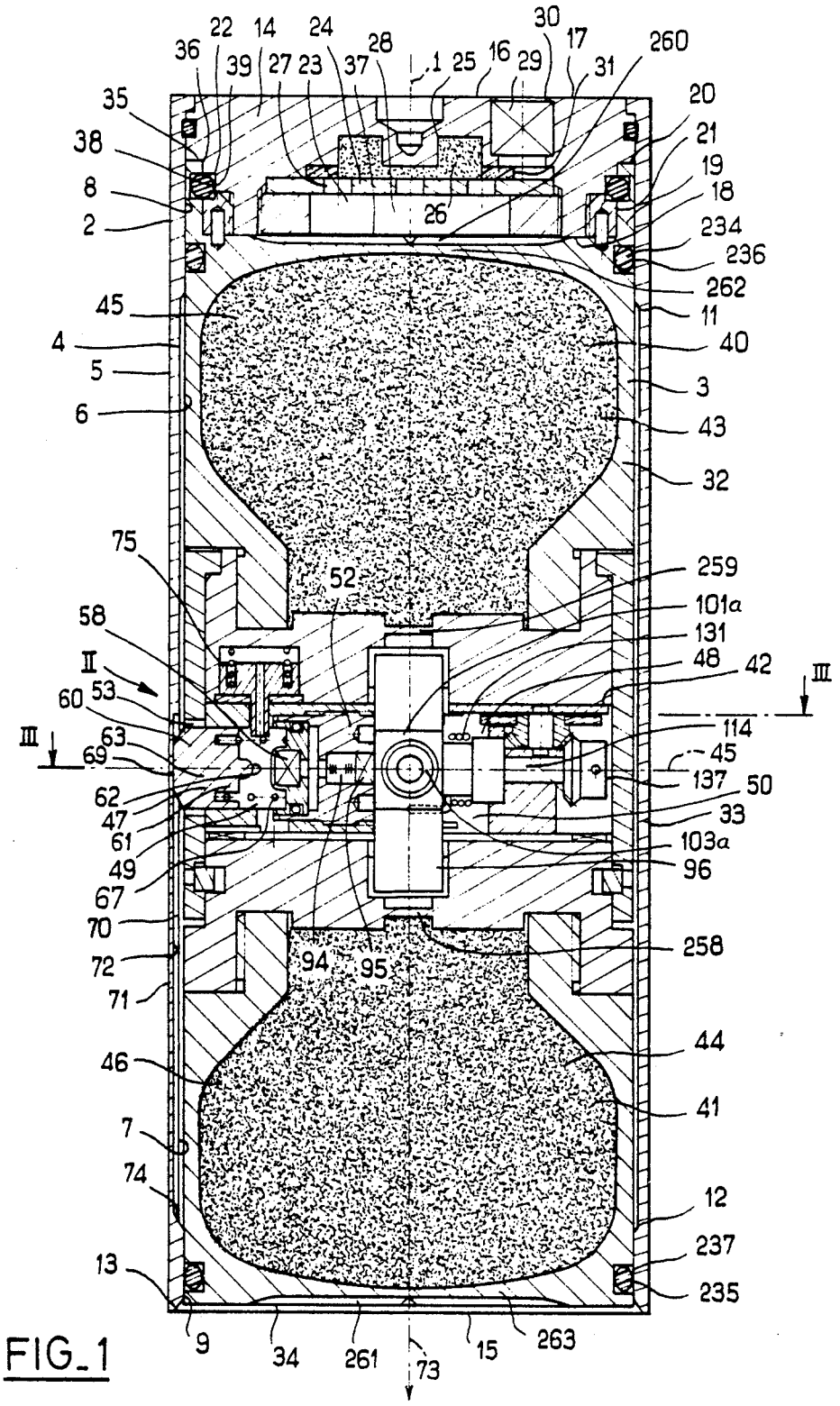
FIG. 1 shows a cartridge in accordance with the invention in the inactive state, meaning that in which it is stored and fitted to a launching device, in cross-section on a median longitudinal plane.

These three figures show the cartridge in accordance with the invention in an application in which the pyrotechnic charge is a flare and in which the cartridge is designed to be slung from an airframe to eject the projectile vertically downwards in order to illuminate the ground or to dazzle an airborne or ground menace after the projectile has travelled sufficiently far from the tube to avoid damage to the airframe by sparks produced when the pyrotechnic charge ignites; however, the characteristic features of the invention could be applied to other type cartridge without departing from the scope of the present invention; specifically, the cartridge in accordance with the invention could be used in other orientations and references to orientations or relative levels in the remainder of the description should be understood as having been used for convenience of description only.

In all the figures the reference number 1 designates a longitudinal reference axis, which is vertical in the embodiment shown, the reference 2 designates the longitudinal tube of the cartridge in accordance with the invention, and the reference number 3 designates the projectile accommodated in and sliding longitudinally of the tube 2.

In a way that is known in itself the tube 2 is formed by assembling together a number of rigid parts which together define:

a tubular wall 4 having an outside peripheral surface 5 which is a cylinder of revolution about the axis 1, an inside peripheral surface 6 comprising a longitudinally central section 7 which is a cylinder of revolution about the axis 1, with a particular diameter, and two longitudinal end sections 8 and 9 which are cylinders of revolution about the axis 1 with the same diameter which is less than that of the central section 7, to which the end sections 8 and 9, which are respectively the upper and lower end in the embodiment shown, are joined by shoulders that are frustums of cones of revolution about the axis 1, respectively denoted 11 and 12; the end section 9, here the lower one, of the inside peripheral surface 6 of the tubular wall of the tube 2 is joined to the outside peripheral surface 5 of the wall 4 by a transverse surface 13 which is an annulus of revolution about the axis 1 and defines an entirely open end of the tubular wall 4 at one end, in this case the lower end;

a transverse tube back wall 14 defining for the tubular wall 4 a closed end 16, here the top end, at the end opposite the open end 15, here the bottom end; to this end the tube back wall 14 has a plane transverse surface 17 external to the tube 2 and in the shape of a disk merging with the outside peripheral surface 5 of the tubular wall 4 in the direction radially away from the axis 1; facing the inside of the tube 2, that is to say downwards in the embodiment shown, the tube back wall 14 has a plane transverse surface 18 in the shape of an annulus of revolution about the axis 1; this surface 18 is situated at an intermediate level on the end section 8 of the inside peripheral surface 6 of the tubular wall 4 and has a maximum or outside peripheral diameter less than that of this end section 8 with which the surface 18 merges in the direction radially away from the axis 1 through the intermediary of a groove 19 that is an annulus of revolution about the axis 1; to be more precise, the groove 19 is defined by a transverse, plane, annular back surface 20 of the same orientation as the surface 18 but situated between the latter and the surface 17 of the wall 14, by a flank surface 21 that is a cylinder of revolution about the axis 1 and faces radially away from this axis so as to merge the back surface 20 of the groove 19 with the surface 18 of the wall 14, with a diameter corresponding to the maximum diameter of the surface 18, and by an area of the end section 8 of the inside peripheral surface 6 of the tubular wall 4 facing the surface 21 in the radial direction.

For reasons that will emerge hereinafter, the flank surface 21 of the groove 19 is hollowed out in the direction radially towards the axis 1 by a continuous groove 22 that is an annulus of revolution about the axis 1; in the direction radially towards the axis 1 the surface 18 of the tube back wall 14 merges with a blind cavity 23 in the tube back wall 14; this cavity 23 is in the general shape of a body of revolution about the axis 1 and is subdivided, by a transverse wall 24 formed with longitudinal perforations 27 and situated at an intermediate level between those of the surfaces 17 and 18 of the tube back wall 14, into a back area 25, relatively nearer the surface 16 and forming a receptacle for an ejector pyrotechnic substance 26, and an area 28 discharging into the surface 18, which area 28 constitutes, together with a transverse surface of the projectile 3 as will emerge hereinafter, an expansion chamber for the gases produced by the ejector pyrotechnic substance 26 and migrating towards this area 28 via the perforations 27 in the wall 24 when the substance 26 is initiated; to this end an igniter 29 of any appropriate type, electrical, for example, is housed within a longitudinal bore 30 in the wall 14, which bore 30 discharges on the one hand into the surface 17 of the wall 14, to permit operation of the igniter 29 from a launch device of known type, not shown, carried by the airframe in the embodiment being described, and on the other hand into the back area 25 of the cavity 23, being separated from the ejector pyrotechnic substance 26 by a porous and permeable barrier 31 preventing migration of the pyrotechnic substance 26 towards the ignitor 29 but permitting the flame from the ignitor 29 to reach the pyrotechnic substance 26.

It will be noted that the means for ejecting the projectile 3 from the tube 2 which have just been described, namely the set of component parts described under reference numbers 23 through 31, could be replaced by alternative ejection means without departing from the scope of the present invention; the determination of their precise characteristics is within the normal competence of those skilled in the art, ejection means analogous to those which have just been described or other ejection means being widely used and the nature of the ejection means not constituting an essential characteristic of the present invention.

It will suffice to add that, when ejection means functioning by the emission of gas are used, as is the case in the embodiment that has just been described, the tube 2 is made in such a way that the tubular wall 4 and the back wall 14 are sealed to each other.

The projectile 3 will now be described in more detail.

Like the tube 2, the projectile 3 comprises a set of component parts forming a unified, rigid and sealed body 32.

Externally, the body 32 is delimited in the direction radially away from the axis 1 by a longitudinal outside peripheral surface 33 that is a cylinder of revolution about the axis 1 and has a diameter as close as possible to that of the end sections 8 and 9 of the inside peripheral surface 6 of the tube 2 and a length, as measured parallel to the axis 1, substantially equal to the distance parallel to this axis between the back surface 20 of the groove 19 and the end transverse surface 13 of the tube 2, so that the surface 33 of the body 32 of the projectile 3 is in contact with the end sections 8 and 9 of the inside peripheral surface 6 of the tubular wall 4 of the tube 2 and this contact guides the projectile 3 as it slides longitudinally relative to the tube 2; facing the respective sections 8 and 9 of the surface 6 in directions radial with reference to the axis 1, the outside peripheral surface 3 of the body 32 comprises two grooves 234, 235 that are annuli of revolution about the axis 1 and each of which accommodates an O-ring 236, 237 providing a seal with the respective corresponding sections 8, 9 of the inside peripheral surface 6 of the tubular wall 4; the O-rings 236 and 237 are designed, in a way that will be obvious to those skilled in the art, to offer minimal impedance to longitudinal sliding of the projectile 3 within the tube 2 and to complete ejection of the projectile 3 form the tube 2 as a result of such longitudinal sliding in a longitudinal direction 73 from the closed end 16 of the tube 2 to its open end 13.

In the direction parallel to the axis 1, the outside peripheral surface 33 of the body 32 is delimited in the immediate proximity of the end surface 13 of the tube 2 by merging with an end transverse surface 34 in the form of a plane disk perpendicular to the axis 1 and, in the immediate vicinity of the back surface 20 of the groove 19, by merging with a plane transverse end surface 35 that is an annulus of revolution about the axis 1 and to which the surface 35 is perpendicular; the surface 35, facing the surface 20 directly and in contact with it, links the outside peripheral surface 23 in the direction radially towards the axis 1 to a flank surface 36 that is a cylinder of revolution about the axis 1 towards which it faces, with a diameter sufficiently close to that of the flank surface 21 of the groove 19 for there to be established between the surfaces 21 and 36 a contact relationship permitting relative longitudinal sliding; the flank surface 36 links the end surface 35 in the direction towards the surface 34 to an end surface 37 of the body 32 which surface 37, set back relative to the surface 35 but having the same orientation as it, is in the form of a plane disk perpendicular to the axis 1 and is applied against the inside surface 18 of the tube back wall 14 so as to delimit in the cavity 23 the aforementioned expansion chamber 28; to this end the flank surface 36 has in the direction parallel to the axis 1 a dimension substantially identical to that of the flank surface 21 of the groove 19 parallel to this axis; note that there is formed in the flank surface 36 a continuous groove 38 which is an annulus of revolution about the axis 1, which groove 38 is radially aligned with the groove 21, with reference to the axis 1, and accommodates in conjunction with the groove 22 an annular key 39 which is sheared as a result of movement of the projectile 3 longitudinally of the tube 2; the characteristics of the key 39 and of the ejector pyrotechnic substance 26 are naturally determined, in a way that will be obvious to those skilled in the art, so that correct functioning of the ejector pyrotechnic substance 26, developing a specific gas pressure in the expansion chamber 28 and applied to the projectile 3, in particular through its surface 37, in the form of a longitudinal force to eject it from the tube 2, will rupture the key 39.

Internally the body 32 is subdivided longitudinally into three sections, namely two end sections 40 and 41, respectively adjacent the surface 37 and the surface 34, and a central section 42.

The two end sections 40 and 41 are hollow and delimit on respective sides of the central section 32 two sealed cavities 43 and 44 that are rigorously symmetrical to each other relative to a plane 45 perpendicular to the axis 1 and situated half way between the surfaces 34 and 37 (this plane coincides with one of the cross-section half-planes marked III—III in FIG. 1); each of the cavities 43 and 44 is in the shape of a body of revolution about the axis 1.

Preferably, and as shown here, the two end sections 40 and 41 delimit the cavities 43 and 44 along the end transverse surfaces 37 and 34 of the body 32 by respective transverse walls 262 and 263 that are identical and mechanically weakened in precisely the same way relative to the walls delimiting these cavities elsewhere, that is to say along the cylindrical outside peripheral surface 33 of the body and along the central section 42; to this end, in the embodiment shown each of the walls 262 and 263 is of decreasing thickness in the direction towards the axis 1 until, where it intersects the axis 1, it is of minimum thickness as measured longitudinally with reference to the respective corresponding end transverse surface 37 or 34; this thickness is reduced, in particular in the immediate vicinity of the axis 1, to a value less than the thickness of the walls delimiting the cavities elsewhere by forming in each of the end transverse surfaces 37 and 34 respective identical rectilinear recesses 260 and 261, of which there are preferably at least three and, for example, six or eight, oriented radially relative to the axis to which they run and regularly spaced around it in the circumferential direction; in the direction parallel to the axis 1 each recess is of constant depth over the major part of its radial span and in particular in the vicinity of the axis 1, and this depth is such that the recesses 260 and 261 do not extend right through the walls 262 and 263 but are adapted to initiate tearing of them in a star pattern.

The two cavities 43 and 44 defined in this way enclose respective pyrotechnic loads 45 and 46 of the same volume, the same weight and the same composition which together constitute the flare pyrotechnic charge of the projectile 3, which is therefore distributed symmetrically to either side of the central section 42 so that, when the charge ignites, it applies to the central section 32 opposed forces which prevent the ejection of sparks from the central section 42 towards the launching airframe or any other launching device or towards the launch personnel.

This naturally presupposes that the two charges 45 and 46 are initiated simultaneously.

Initiation means 47 provided for this purpose are accommodated in the central section 42, which to this end comprises an internal cavity 48 sealed from the two cavities 43 and 44.

Figure 2:
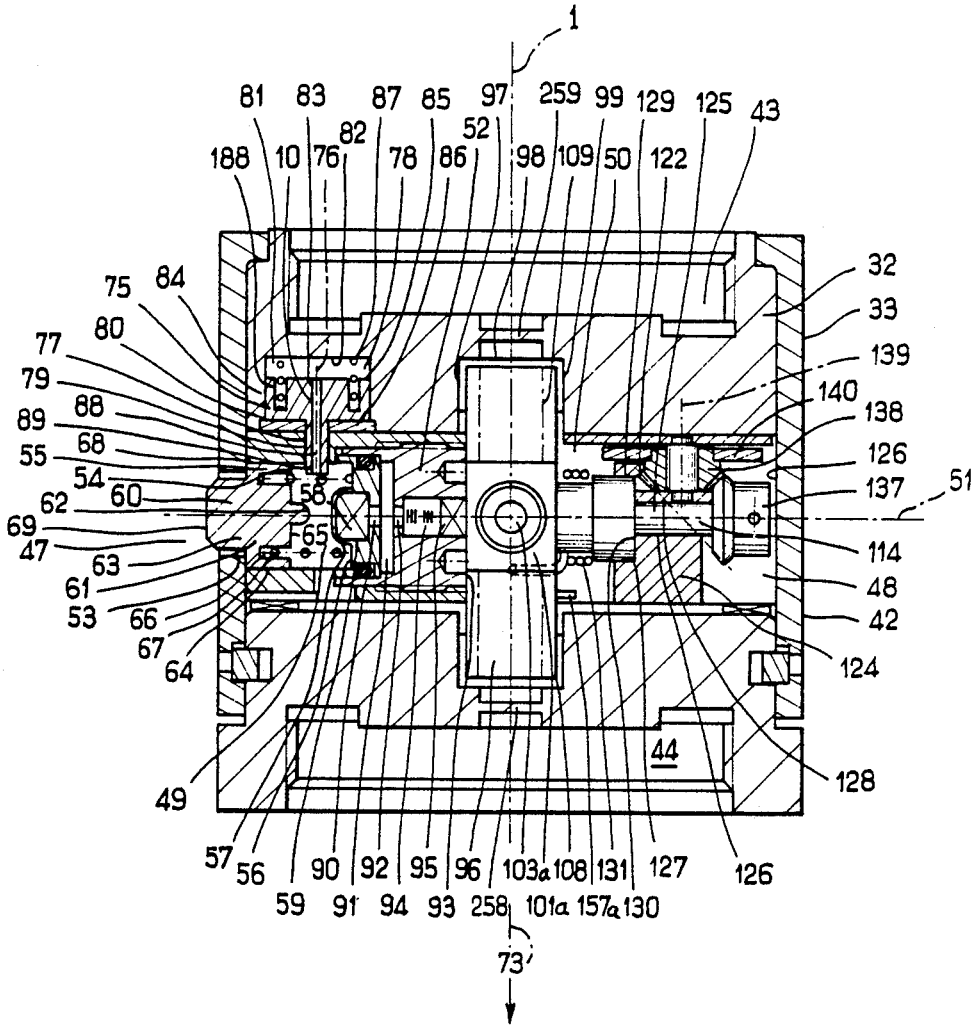
FIG. 2 shows to a larger scale the detail marked II in FIG. 1.
Figure 3:
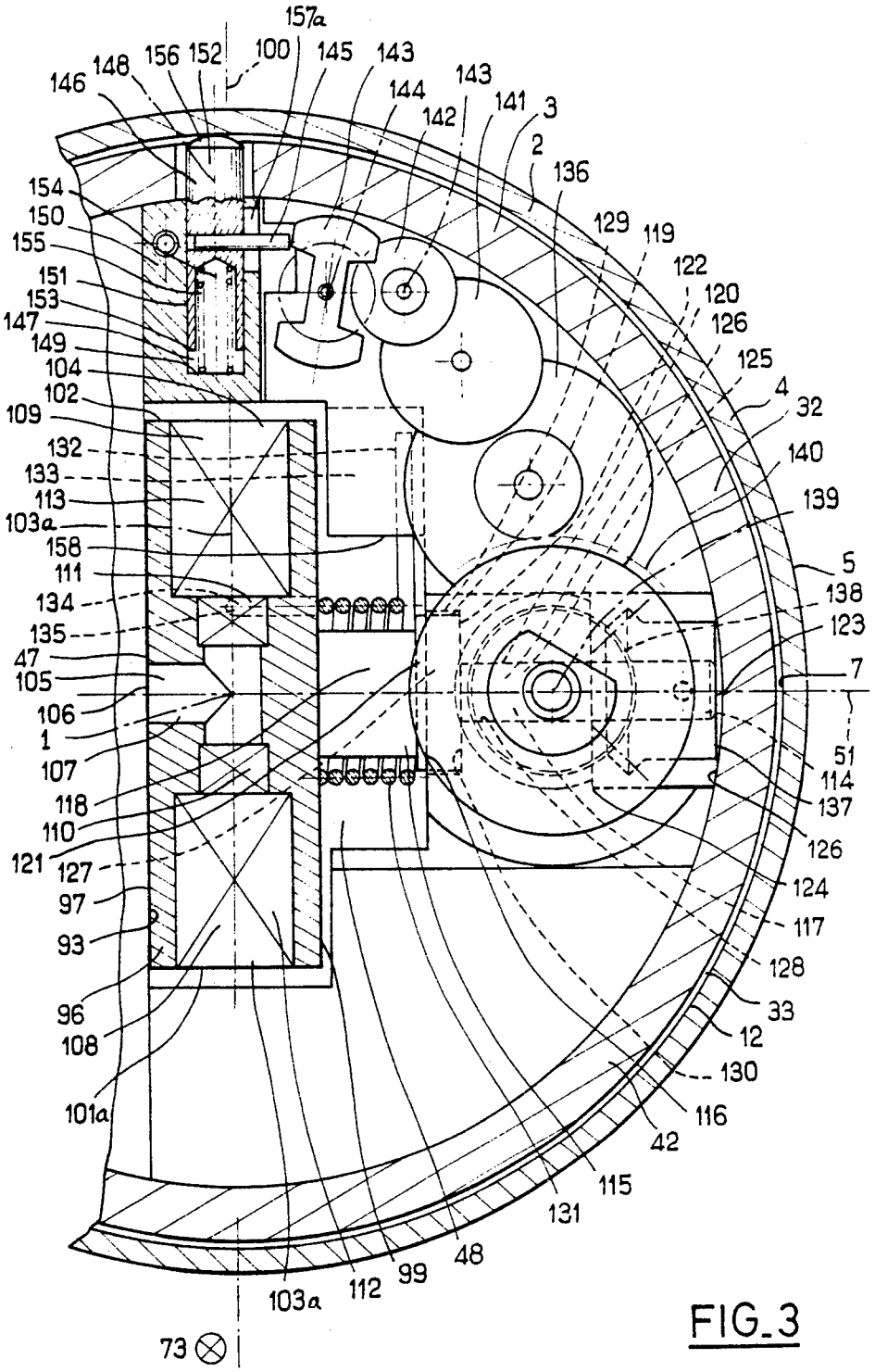
FIG. 3 shows the cartridge in cross-section on two transverse half-planes marked III—III in FIG. 1.

The central section 42 of the projectile 3 and the means 47 for initiating the charges 45 and 46 are seen particularly clearly in FIGS. 2 and 3, to which reference should be had for the remainder of this description.

The cavity 48 in the central section 42 of the projectile 3 is in turn subdivided in a fluid-tight manner into two chambers 49 and 50 juxtaposed to each other along an axis 51 intersecting the axis 1 and situated in the plane 45, that is to say perpendicular to the axis 1; to this end there is provided inside the cavity 48 a sealed partition 52 perpendicular to the axis 51 and offset along this axis relative to the axis 1 so that the chamber 50, which is sealed, intersects this axis and so that the chamber 49, which is sealed from the chamber 50 but not from the outside of the projectile 3, lies wholly on one side of the axis 1 in the direction 51; the sealed partition 52 is fixed relative to the remainder of the body 32 of the projectile 3.

In the direction along the axis 51 the chamber 49 discharges into the outside peripheral surface 33 of the body 32 of the projectile 3 through an opening 53 which is in the shape of an oblong parallel to the axis 1, with a cross-section that is advantageously rectangular perpendicular to the axis 51; within the cavity 48 the chamber 49 is delimited around the opening 53 by a surface 54 facing towards the axis 1 and having the shape of part of a cylinder of revolution about the axis 1, which surface 54 defines a shoulder on average perpendicular to the axis 51 around the opening 53; the chamber 49 is further delimited by a surface 55 that is a cylinder of revolution about the axis 51 and which links the surface 54 in the direction towards the axis 1 parallel to the axis 51 to a surface 56 that is an annulus of revolution about the axis 51, to which it is perpendicular, that the partition 52 features in the direction away from the axis 1 along the axis 51; this surface 56 in turn links the surface 55 in the direction radially towards the axis 51 to a rim 57 that is an annulus of revolution about the axis 51 and which is part of the partition 52, projecting into the chamber 49, which rim 57 serves to crimp a fuse 58 inside a housing 59 along the axis 51 that is part of the partition 52; the housing 59 discharges into the chamber 49 inside the rim 57 to permit percussive initiation of the fuse.

To this end there is mounted inside the chamber 49, to slide along the axis 51, a part 60 of unitary construction comprising a flyweight 61 disposed in the chamber 49, a percussion member or firing pin 62 on the side of the flyweight 61 facing towards the axis 1 along the axis 51 and a finger 63 on the side of the flyweight 61 facing away from the axis 1 along the axis 51.

To be more precise, the flyweight 61 has the generally shape of a body of revolution about the axis 51 and is delimited in the direction radially away from the axis 51 by an outside peripheral surface 54 that is a cylinder of revolution about the axis 51 with a diameter as close as possible to that of the cylindrical surface 55 of the chamber 49 so that contact between the surfaces 64 and 55 serves to guide the part 60 when it slides along the axis 51 relative to the body 33 of the projectile 3; in the direction towards the axis 1, that is to say towards the partition 52, the surface 64 of the flyweight 61 is delimited by merging with a plane surface 65 perpendicular to the axis 51 which includes, directly facing the annular surface 56, parallel to the axis 51, a groove 66 which is a body of revolution about the axis 51, while the surface 65 comprises, directly opposite the fuse 58 and projecting along the axis 51, the striking pin 62, which is of hemispherical shape, for example, centered on the axis 51; the groove 66 receives an end turn of a helical compression spring 67 on the axis 51 which has another end turn pressing against the annular surface 56 of the sealed partition 52 so that the spring 67 elastically holds the part 60 as a whole in a position as far removed as possible from the partition 52 and the axis 1 along the axis 51, that is to say in a position in which the flyweight 61 is butted against the shoulder surface 54 of the chamber 49, through a plane annular surface 58 perpendicular to the axis 51 facing away from the surfce 55 and merging with the surface 64 in the direction radially away from the axis 51; the finger 63 projects along the axis 51 relative to this surface 68 and has a rectangular cross-section perpendicular to the axis 51 which fits within the cross-section of the opening 53 so that, when the surface 58 of the flyweight 61 bears against the surface 54 of the chamber 49 the finger 63 is freely inserted into the opening 53; in the direction along the axis 51 the length of the finger 63 is greater than the distance then separating the surface 68 and the outside peripheral surface 33 of the body 32, so that the finger 63 features at the end opposite that at which it merges with the flyweight 61 along the axis 51 an end part 69 projecting outside the projectile 3, relative to its outside peripheral surface 33.

As can be seen in FIG. 1, the projection thus formed by the end part 69 of the finger 63 relative to the outside peripheral surface 33 of the body 32 of the projectile 3 has a dimension along the axis 51 that is greater than the difference between the respective diameters of the surface 33 and the central section 7 of the inside peripheral surface 6 of the tubular wall 4 of the tube 2, although it is less than the difference between the respective diameters of the surface 33 and the outside peripheral surface 5 of the aforementioned tubular wall 4, and the projecting end 69 of the finger 63 is accommodated in a rectilinear groove 70 parallel to the axis 1 formed in the central section 7 of the inside peripheral surface 6 of the tubular wall 4, from an area situated directly facing the central section 42 of the body 32 of the projectile 3 up to the shoulder 12 at which the central section 7 of the inside peripheral surface 6 of the tubular wall 4 merges with the end section 9 of this surface 6; featuring parallel to a mean longitudinal plane coincident with the cross-section plane of FIGS. 1 and 2 flanks 71 sufficiently far apart to permit free longitudinal sliding of the end 69 of the finger 63 when the projectile 3 slides longitudinally within the tube 2, as on ejection, for example, the groove 70 is delimited in the direction away from the axis 1 by a plane back 72 parallel to the axis 1 and perpendicular to the mean longitudinal plane of the groove 70, which back 72 is spaced from the axis 1 by a distance substantially corresponding to the maximum separation of the end 69 of the finger 63 from the axis 1, in the direction along the axis 51; however, in the longitudinal direction 73 running from the end 16 of the tube 2 to its end 13, which direction 73 is in this instance downwards and constitutes the direction in which the projectile 3 moves relative to the tube 2 on ejection, the back 72 merges with the shoulder 12 through a facet 74 directly extending the shoulder 12 in the direction away from the axis 12, obliquely thereto, and in the upstream sense with reference to the direction 73.

The facet 74 and the shoulder 12 together constitute a cam surface that converges with the axis 1 in the ejection direction 73 and which, when the projectile 3 moves in the ejection direction 73 relative to the tube 2, with the end 69 of the finger 63 sliding in the same direction along the bottom 72 of the groove 70, intercepts the end 69 of the finger 63 and, by causing the end 69 of the finger 63 to be retracted relative to the outside peripheral surface 33 of the body 32 of the projectile 3, impells the part 60 as a whole towards the axis 1 along the axis 51, with a kinetic energy that is high because the speed at which the end 69 of the finger 63 passes over the cam surface thus formed by the facet 74 and the shoulder 12 is high; the spring 67 naturally opposes any such movement of the part 60 but it is calibrated to permit movement of this part until the firing pin 62 strikes the fuse 58 and initiates this form a predetermined threshold of the speed at which the end 69 of the finger 63 passes longitudinally over the cam surface 12–74, that is to say from a predetermined threshold speed of ejection of the projectile 3 from the tube 2.

In an alternative embodiment the groove 70 would be eliminated and the difference between the respective diameters of the outside peripheral surface 33 of the body 32 of the projectile and the central section 7 of the inside peripheral surface 6 of the tubular wall 4 would be chosen substantially equal to the size of the projection of the end 69 of the finger 63 relative to the outside peripheral surface 33 of the body 32 of the projectile when the flyweight 61 bears through the surface 68 on the surface 54; the whole of the recess constituted by the central section 7, relative to the end sections 8 and 9, would then fulfill the same role as the bottom 72 of the groove 70 described previously and the shoulder 12 would of itself constitute the cam surface which the end 69 of the finger 63 would pass over on ejection of the projectile to impart the aforementioned impulse to the part 60.

It will be noted that the percussion mode that has just been described, involving an impulse conditioned by the ejection speed and preventing percussion if this speed is insufficient, offers a safety measure against initiation of the charges 45 and 46 when the projectile is too close to the launch personnel and device because of an insufficient ejection speed.

However, a violent impact applied to the combination of the projectile 3 and the bush 2 with the device as a whole in the state shown could bring about percussion accidentally, by overcoming the action of the spring 67.

To prevent any such accident, that might occur during handling of the cartridge, for example, there is provided an inertial bolt 75 which prevents movement of the part 60 away from the position disengaged from the fuse 58, in which position the end 69 of the finger 63 projects relative to the outside peripheral surface 73 of the body 32 on the projectile, to the position in which it strikes the fuse 58 unless the projectile 3 is also subject to longitudinal acceleration in the direction 73.

To this end, along an axis 76 parallel to the axis 1 and perpendicular to the axis 51 is a bore 77 discharging into an area of the cylindrical surface 55 of the chamber 49 situated on the upstream side with reference to the direction 73, that is say above the axis 51 in the embodiment shown; the bore 77 links the chamber 49 to another chamber 78 formed in the body 42 of the projectile 3 on the upstream side of the chamber 49 with reference to the ejection direction 73, that is to say above the chamber 49 in the embodiment shown; the bore 77 is delimited in the direction radially away from the axis 78 by a surface 79 that is a cylinder of revolution about the axis 76 and which links the cylindrical surface 55 of the chamber 49 to a plane annular surface 80 perpendicular to the axis 76 and facing away from the chamber 49 along the axis 76; the surface 80 links the surface 79 in the direction radially away from the surface 76 to a peripheral surface 81 of the chamber 78 which is a cylinder of revolution about the axis 76 towards which it faces, with a diameter greater than that of the surface 79 of the bore 77; the surface 81 links the surface 80 in the direction away from the chamber 49 along the axis 76 to a surface 82 in the shape of a plane disk perpendicular to the axis 76 facing the surface 80.

Inside the chamber 78 is a flyweight 83 that slides along the axis 76 and to this end has an outside peripheral surface 84 that is a cylinder of revolution about the axis 76 and a diameter as close as possible to that of the surface 81 so that the surfaces 81 and 84 are in contact to guide relative sliding along the axis 76; the surface 84 is delimited in the direction parallel to the axis 76 by merging with two plane surfaces 85 and 86 each of which is an annulus of revolution about the axis 76 to which they are perpendicular, the surface 85 facing the surface 82 and the surface 86 facing the surface 80; the distance parallel to the axis 76 separating the surfaces 85 and 86 is less than the distance parallel to this axis separating the surfaces 82 and 80 in order to permit relative movement of the flyweight 83 along the axis 76 inside the chamber 78; a helical compression spring 87 on the axis 76 bearing on the one hand against the surface 82 of the chamber 78 and on the other hand in a groove 188 which is an annulus of revolution about the axis provided in the surface 85 of the flyweight 83 urges the latter elastically towards a position shown in FIG. 1 in which the surface 86 of the flyweight 83 bears against the surface 80 of the chamber 78; in this position a finger 88 attached to the flyweight 83 and projecting along the axis 76 relative to the surface 86 of the flyweight 83, having perpendicular to the axis 76 a cross-section that is inscribed with clearance within that of the surface 79 of the bore 77, extends through the bore 77 so that its end part 89 projects towards the axis 51 along the axis 76 inside the chamber 49 and relative to the cylindrical surface 55 of the chamber 49; the position of the bore 77 is chosen so that the projection which the end part 89 of the finger 88 thus forms is situated between the position of the surface 65 of the flyweight 61 when the surface 68 of the latter bears against the surface 54 of the chamber 49 and the position of the annular surface 56 of the partition 52, so as to provide the necessary obstacle to the part 60 moving to its position in which the fuse 58 is struck by the firing pin 62; the size of this projection as measured parallel to the axis 76 is, however, less than the distance parallel to this axis between surfaces 85 and 82, that is to say the possible range of movement of the flyweight 83 within the chamber 78; thus immediately ejection of the projectile 3 from the tube 2 begins due to the force resulting from the pressure of the gases accumulating in the chamber 28 the flyweight 83 moves upstream with reference to the direction 73 until stopped by its surface 85 and it remains in this position at least throughout the duration of the longitudinal movement of the projectile 3 within the bush 2 as it is ejected, which retracts the end part 89 of the finger 88 relative to the surface 55 and from the chamber 49 and so allows the part 60 to move past it when, provided the ejection speed is efficient, the cam surface 74-12 causes the part 60 to move towards the position in which the fuse 58 is struck by the firing pin 62; a passage 10 right through the finger 88 and the flyweight 83 along the axis 76 constitutes a vent from the chamber 78 into the chamber 49 on movement of the flyweight 83 in the direction which retracts the end part 89 of the finger 88.

It will be noted that such release requires the flyweight 83 to receive an impulse perpendicular to the direction in which the part 60 is itself to receive an impulse in order to reach the percussion position; given these conditions, accidental percussion necessitates the application to the cartridge of a force having sufficiently high energy components in two directions at 90°, namely the direction of the axis 51 and the direction of the axis 1, which makes the probability of any such accidental percussion extremely low.

To allow fire to pass from the fuse 58, once it has been struck, to the charges 45 and 46 the housing 59 provided for the fuse 58 inside the partition 52 is extended along the axis 51 towards the axis 1 by a fire transmission channel 90 which discharges in the direction towards the axis 1 into an expansion chamber 91 also formed within the partition 52; into this expansion chamber 91, which is also sealed, there also discharges, directly opposite the channel 90 in the direction of the axis 51, a fire transmission channel 92 formed along the axis 51 in the partition 52 and discharging into a surface 93 which delimits the partition 52 in the directions towards the axis 1 and towards the chamber 50; in the direction from the chamber 91 to the chamber 50 the channel 92 contains in succession, attached to the partition 52, a pyrotechnic delay device 94 directly facing the fuse 58 and a pyrotechnic relay device 95 directly adjacent the surface 93.

The surface 93 is plane and perpendicular to the axis 51; a plane surface 97 also perpendicular to the axis 51 of a detonator support wheel 96 constituting a supplementary safety device now to be described bears against and can slide relative to the surface 93.

The wheel 96 is delimited on the same side as the partition 92 by the plane surface 97, which is for the most part an annulus of revolution about the axis 51, to which it is perpendicular, and is delimited in the direction away from the axis 51 by a surface 98 that is for the most part a cylinder of revolution about the axis 51 and has a diameter compatible with its accommodation inside the chamber 50, this surface 98 linking the surface 97 in the direction away from the partition 52 and parallel to the axis 51 to a plane surface 99 parallel to the axis 51 and in the general shape of an annulus of revolution about the axis 51; this surface 99 occupies a position symmetrical to that of the surface 97 relative to a longitudinal plane 100 including the axis 1 and disposed perpendicular to the axis 51; despite its general shape being that of a cylinder of revolution about the axis 51, the surface 98 has two flats **101*a* and 102 diametrally opposed relative to the axis 51 and perpendicular to a common axis 103 associated with the wheel 96, perpendicular to the axis 51 and situated in the plane 100; in each of the flats 101*a* and 102 is a respective outlet 103*a* or 104 from a passage 105 formed in the detenator support wheel 98 and also having an outlet 106 in the surface 97 of the wheel 98 on the axis 51, that is to say directly facing the relay devices 95**.

This passage 105 is generally T-shaped when, as in FIG. 3, seen in a plane including the axes 51 and 103, this shape being defined by a branch 107 extending into the wheel 96 from the outlet 106 on the surface 97 thereof, along the axis 51, and by two branches 108 and 109 aligned with each other along the axis 103, on respective sides of the branch 107 and respectively connecting the latter to the outlet **103*a* in the flat 101*a* and to the outlet 104 in the flat 102; in a direction running from the branch 107, that is to say the axis 51, to the respective outlet 103*a* or 104, along the axis 103, each of the branches 108 and 109 contains in succession and fastened to the detonator support wheel 96, a respective pyrotechnic relay device 110, 111 connected by the branch 107 to the relay device 95 and a respective pyrotechnic detonator device 112, 113 directly adjacent the outlet 103*a* and 104**.

When the projectile 3 is inserted in the tube 2 as shown, the detonator support wheel 96 occupies the orientation shown in which the axis 103 is perpendicular to the axis 1, so that the outlets **103*a* and 104 of the branches 108 and 109 of the passage 105 are as far as possible away from the operational charges 45 and 46, and mechanical arming means are provide to cause rotation of the detonator support wheel 96 about the axis 51 relative to the body 32 of the projectile 3, through 90°, so as to align the axis 103 with the axis 101 and so bring the outlets 103*a* and 104 from the passage 105 respectively into line with the operational charge 46 and the operational charge 45, as schematically represented in part and in chain-dotted line for the branches 108 and 109 in FIG. 2, after a predetermined time has elapsed from complete ejection of the projectile 3 from the tube 2**.

To this end the detonator support wheel 96 has fixed to it and projecting along the axis 51 from its surface 99 a rod 114 having starting from the surface 109 and along the axis 51 successive sections 115, 116 and 117 each of which is delimited in the direction away from the axis 51 by a respective peripheral surface 118, 119, 120 that is a cylinder of revolution about the axis 51, the diameter of the surface 120 being less than that of the surface 118 which is in turn less than that of the surface 119 which is in turn less than that of the surface 98 of the detonator support wheel 96; the surface 119 is linked by respective plane surfaces 121 and 122 that are annuli of revolution about the axis 51 to the surfaces 118 and 120; opposite where it is linked by the surface 122 to the surface 119 along the axis 51, the surface 120 merges with a plane end surface 123 of the rod 114 perpendicular to the axis 51.

In a complementary way, the body 32 of the projectile 3 has fastened to it, inside the chamber 50 and opposite the partition 52 relative to the axis 1, a partition 124 situated approximately halfway between the detonator support wheel 96 and a surface 126 symmetrical to the surface 54 relative to the axis 1 and delimiting the chamber 50 in the direction radially away from the axis 1 along the axis 51, this partition 124 comprising a bore 125 along the axis 51; the bore 125 has two sections 126 and 127 delimited in the direction towards the axis 51 by inside peripheral surfaces 128 and 129 which are both cylinders of revolution about the axis 51; the surface 129, corresponding to the section 127 nearer the axis 1, has a diameter greater than that of the surface 119 of the section 116 of the rod 114, whereas the surface 128 of the section 126 further from the axis 1 has a diameter that is as close as possible to the that of the surface 120 of the section 117 of the rod 114, so as to procure with this surface 128 a contact relationship guiding relative rotation of the rod 114 and the partition 124, that is to say rigorous guiding of the detonator support wheel 96 on rotation about the axis 51 relative to the body 32 of the prjectile 3; the two surfaces 128 and 129 are linked to each other by a surface 130 perpendicular to the axis 51 which is an annulus of revolution about this axis and which is situated at a distance from the surface 93 of the partition 52 as close as possible to the distance between the surface 122 of the rod 114 and the surface 97 of the detonator support wheel 96, so that there is established between the surfaces 122 and 130 a sliding contact which, together with the sliding contact established between the surface 97 of the detonator support wheel 96 and the surface 93 of the partition 52, prevents any translational movement of the combination comprising the detonator support wheel 96 and the rod 114 along the axis 51 relative to the body 32 of the projectile 3.

A torsion spring 131 wound around the surface 118 of the section 115 and of the rod 114 and having a first end 132 attached to the body 32 by insertion into an appropriate housing 133 in the latter and a second end 134 attached to the detonator support wheel 96 by insertion in a complementary housing 135 provided in the surface 99 of the wheel 96 is prestressed when the axis 103 is perpendicular to the axis 101 and so tends to cause rotation of the detonator support wheel 96 into a position with the axis 103 aligned with the axis 100; the prestressing of the torsion spring 131 is advantageously such that the spring remains stressed even when the axis 103 is aligned with the axis 101.

Any such rotation leading to alignment of the axis 103 with the axis 1 is prevented until a predetermined time-delay has elapsed from the projectile 3 leaving the tube 2 by a timer 136 with which the detonator support wheel 96 cooperates through the intermediary of a bevel gear 137 carried by and fastened to the section 117 of the rod 114, between the partition 124 and the surface 126 of the chamber 50; this gear 137 meshes with another bevel gear 138 rotatable about an axis 139 parallel to the axis 1 relative to the body 32 of the projectile 3 and itself carrying and fastened to a spur gear 140 meshing through the intermediary of a step-down gear train generally designated by the reference numeral 141 with an escape wheel 142 mounted in the chamber 50 to rotate relative to the body 32 of the projectile 3 about an axis 143 parallel to the axis 1; this wheel 142 cooperates with a pawl **143*a* also disposed in the chamber 50 and rotatable relative to the body 32 about an axis 144 parallel to the axis 1**.

While the projectile 3 is inside the tube 2 as shown, the pawl **143*a* is prevented from rotating about the axis 144 relative to the body 32 of the projectile 3 by a peg 145 at this time immobilized relative to the body 32 of the projectile 3, which prevents any rotation of the escape wheel 142 and thus of the detonator support wheel 96**.

To enable the peg 145 to release the pawl 143 once the projectile 3 has left the tube 3, in other words to permit rotation of the escape wheel 142 as a result of the force applied by the spring 131 via the step-down gear train 141, with rotation regulated by the escape pawl **143*a*, when the projectile 3 has left the tube 2, the peg 145 is carried by and fastened to a finger 146 most of which is accommodated in a blind hole 147 provided in the body 32 of the projectile 3 in a direction 148 that is approximately radial relative to the axis 101, this blind hole 147 opening into the outside peripheral surface 33 of the body 32 of the projectile; the blind hole 147 is formed, for example, in a partition 150 fastened to the body 32 in the immediate vicinity of the pawl 143*a* and has a plane bottom surface 149 perpendicular to the axis 148 and a peripheral surface 151 that is a cylinder of revolution about the axis 148; in a complementary way, the finger 146 is delimited by an outside peripheral surface 152 that is a cylinder of revolution about the axis 148 with a diameter as close as possible to that of the surface 151, in order to establish contact to guide sliding movement between the surfaces 151 and 152 along the axis 148; in the direction towards the bottom surface 149 of the blind hole 147 the finger 146 is delimited by a plane end surface 143 perpendicular to the axis 148 in which is a blind hole 154 along this axis serving to accommodate and guide a helical compression spring 155 operative between the bottom surface 149 of the blind hole 147 and the finger 146 to urge the latter elastically in the direction to cause it to project out of the blind hole 147 and the outside peripheral surface 33 of the body 32 of the projectile; at the opposite end to the surface 153 along the axis 148 the finger 146 is delimited by a rounded convex surface 156 through which, being acted on by the spring 155, it bears against the central section 7 of the inside peripheral surface 6 of the tubular wall 4 of the tube 2 when the projectile 3 is inserted in the latter, as shown in the figures, and—during ejection—for as long as the blind hole 147 moves across the section 7 and then the section 9 of the inside peripheral surface 6 of the tubular wall 4; on the other hand, as soon as the section 9 has been passed over during ejection the release finger 146 is pushed out of the blind hole 147 in the direction of the axis 148 by the action of the spring 155**.

As seen in FIG. 3, the peg 145 is carried by and fastened to the finger 146, is perpendicular to the axis 148 and passes through the partition 150 from the hole 147 to the pawl **143*a* via an opening 157 provided in the partition 150**, having an oblong shape parallel to the axis 148; parallel to this axis the opening 157 is of sufficient size that, beginning from its position immobilizing the pawl 143*a* as shown in FIG. 3, corresponding to the surface 156 of the finger 146 bearing on the central section 7 of the inside peripheral surface 6 of the tube 2, the peg 145 can accomplish sufficient travel parallel to the axis 148, conjointly with the finger 146 when this is released from the inside peripheral surface 6 of the tube 2, to release the pawl 143*a* completely; choosing appropriate dimensions is within the ordinary competence of those skilled in the art.

Immediately the pawl 143*a* is released from the peg 145 it authorizes regulated rotation of the escape wheel 142 about the axis 143 and of the detonator support wheel 96 about the axis 51, the driving force being provided by the spring 131.

The gear 140 advantageously has teeth over part only of its periphery, meshing with the gear train 141 when the axis 103 is perpendicular to the axis 1 and, starting from this orientation, over part of the 90° rotation necessary to pass from this orientation to an orientation with the axis 103 aligned with the axis 1, to establish regulated rotation of the assembly comprising the escape wheel 142 and the pawl 143*a* while this part of the circumferential travel is being accomplished, to subsequently release the detonator support wheel 96 completely with regard to continued rotation about the axis 51 under the action of the spring 131 until the axis 103 is aligned with the axis 1.

The pyrotechnic delay device 94 and the timer 136 are designed in a way that will be readily apparent to those skilled in the art with regard to the respective time-delays that they introduce into the initiation of the detonators 112 and 113 via the relay devices 110 and 111 relative to striking of the fuse 58 when the end 69 of the finger 63 passes over the cam surface 12-74 at a sufficient speed and with the axis 103 aligned with the axis 1 relative to the disengagement of the finger 146 from the wall 4 of the tube 2, so that the alignment of the axis 103 with the axis 1 occurs at the very latest before the end of combustion of the pyrotechnic relay device 94, given permissible manufacturing tolerances.

Rotation of the detonator support wheel 96 about the axis 51 relative to the body 32 of the projectile 3 when the axis 103 is aligned with the axis 1 may be halted by any abutment system, for example by having a peg 157*a* carried by and fastened to the detonator support wheel 96, projecting from its surface 99 parallel to the axis 51 inside the chamber 50, butt up against an abutment counter-member 158 fastened to the body 32 of the projectile 3 inside the chamber 50, in a suitable position that can be easily determined by those skilled in the art.

The cartridge that has just been described operates in the following way.

The state shown in the figures will be taken as the initial state, to which the following description applies for the most part.

In a first phase the igniter 29 is initiated and in turn initiates the ejector pyrotechnic substance 26 which emits gases which accumulate in the expansion chamber 28, passing through the perforations 27 in the wall 24.

When the pressure of the gases in the chamber 28 becomes sufficient to overcome any friction there may be between the body 32 of the projectile 3 and the tube 2 and to overcome the resistance of the key 39 to being sheared, the projectile 3 begins to move in the direction 73 along the axis 1 inside the tube 2.

During this movement the end part 69 of the finger 63 of the part 60 and the surface 156 of the finger 146 slide longitudinally against the groove bottom 72 and against the inside peripheral surface 6 of the tubular wall 4 of the tube 2.

If the acceleration to which the projectile 3 is subjected is sufficient, the flyweight 83 causes the end part 89 of the finger 88 to be retracted relative to the surface 55 of the chamber 49 and maintains this retraction at least until the projectile 3 has totally left the tube 2.

When the projectile 3 has covered approximately half the travel needed for it to leave the tube 2 completely, the following occur simultaneously or virtually simultaneously:

the end 69 of the finger 63 on the part 60 receives from the cam surface consisting of the surface 74 and the shoulder 12, passed over in a direction corresponding to radial movement towards the axis 1, an impulse which, if the ejection speed is sufficient, gives the flyweight 61 sufficient kinetic energy to move the part 60 to the position in which the fuse 58 is struck by the firing pin 62, provided that the end part 89 of the finger 88 has been retracted, of course; this results in initiation of the delay device 94 which, after a predetermined time-delay, in turn initiates the relay device 95 which in turn initiates the relay devices 110 and 111 which simultaneously ignite the detonators 112 and 113;

the finger 146 escapes from the inside peripheral surface 6 of the tubular wall 4 and releases the pawl 143, whereupon the detonator support wheel 96 begins to rotate and, after a predetermined time interval, reaches the position with the axis 103 aligned with the axis 1.

Under normal conditions of operation this orientation is achieved before the detonators 112 and 113 are lit and these latter explode directly opposite the operational charges 46 and 45, respectively, from which they are separated along the axis 1 by only a respective partition 258, 259 of the body 2 that has been made thinner, that is to say mechanically weakened; the two partitions 258, 259 are destroyed by the shockwave and the fire passes to the two operational charges 45 and 46 which ignite simultaneously.

If, on the other hand, the two detonators 112 and 113 explode before the axis 103 is aligned with the axis 1, the shockwave is not transmitted directly to the weakened partitions 258, 259, which are designed not to be destroyed in this case, so that no transfer of fire to the operational charges 45 and 46 occurs; this protects against possible failure of the pyrotechnic delay device 94, leading to an excessively short initiation time for the detonators 112 and 113, assuming that ejection has taken place with sufficient acceleration and speed to cause on the one hand retraction of the end part 89 of the finger 88 and on the other hand the firing pin 62 of the part 60 to strike the fuse 58.

If, on the other hand, the acceleration or speed of ejection is insufficient, and even if the timer 136 functions correctly to enable the axis 103 to be aligned with the axis 1, percussion cannot take place until the time-delay for the axis 103 to be aligned with the axis 100 has expired, so that the operational charges 45 and 46 cannot be ignited.

It is therefore certain that these charges cannot ignite after the projectile has exited from the tube 2 by a distance that is insufficient from the safety point of view.

Also, as has already been stated, as soon as the operational charges 45 and 46 ignite, as these charges are symmetrically disposed relative to the central section 42 they apply symmetrical forces to the latter which avoids it being projected towards the launching personnel and device, for example.

This effect is reinforced by the mechanical weakening of the partitions 262 and 263 delimiting the cavities 43 and 44 at the level of the end transverse surface 37 and 34 of the body 32 of the projectile by the recesses 260 and 261; this weakening favours tearing of the walls 262 and 263 in a petal-like pattern with priority over the walls delimiting the cavities 43 and 44 when the operational charges 45 and 46 ignite, and this tearing of the walls 262 and 263 channels longitudinally the fluxes resulting from the ignition of the charges 45 and 46, respectively, and converts these into symmetrically opposed longitudinal forces applied to the central section 42.

Although the embodiment that has just been described constitutes a currently preferred embodiment of the invention, it is to be understood that modifications may be made to this embodiment without departing from the scope of the invention.

In particular, in a less advantageous alternative embodiment, a single operational load could be provided disposed to one side only of a section of projectile containing initiator means 47 in every respect analogous to those that have just been described, except that the passage 105 would be L-shaped rather than T-shaped; all the advantages previously described would then be retained except for the advantage associated with the symmetry of the device as shown in the figures.

There is claimed:

1. Projectile comprising a pyrotechnic charge, a mobile member in said projectile adapted to rotate between a safe position and an armed position, a passage in said mobile member, a pyrotechnic delay device at least part of which is accommodated in said passage and means for initiating said pyrotechnic charge via said pyrotechnic delay device, said passage being oriented so as to isolate functionally said pyrotechnic delay device from said pyrotechnic charge when said mobile member is in said safe position and to couple functionally said pyrotechnic delay device to said pyrotechnic charge when said mobile member is in said armed position, said projectile further comprising means on said mobile member and on said projectile to guide relative rotation between them about an axis fixed relative to said mobile member and relative to said projectile and mechanical arming means adapted to retain said mobile member in said safe position and against rotation about said axis relative to said projectile at least until said projectile is fired and to oblige said mobile member to move to said armed position when said projectile is fired by rotating about said axis relative to said projectile, said mechanical arming means comprising spring means adapted to urge said mobile member continuously to rotate about said axis towards said armed position, retaining means for holding said mobile member in said safe position against the action of said spring means at least until said projectile is fired, means for sensing when said projectile is fired and responding thereto by enabling rotation of said mobile member towards said armed position, and abutment means for said mobile member on rotation relative to said projectile against the action of said spring means in said armed position.

2. Projectile according to claim 1, wherein said mechanical arming means further comprise delay means adapted to delay movement of said mobile member to said armed position relative to firing of said projectile.

3. Projectile according to claim 1, wherein said axis is transverse to a longitudinal direction in which said projectile is fired.

4. Projectile according to claim 1, wherein said pyrotechnic charge is a flare.

5. Projectile according to claim 1, wherein said projectile is fired by sliding longitudinally of a tube and said sensing means comprise a transverse hole discharging into a longitudinal surface of said projectile, a transverse finger adapted to slide transversely in said hole, spring means urging said finger towards a position in which it protrudes transversely from said longitudinal surface of said projectile and means coupling said finger with said retaining means so that said retaining means hold said mobile member in said safe position when said finger is in abutting relationship to said tube and release said mobile member by virtue of sliding of said finger in the direction resulting in it protruding from said longitudinal surface of said projectile.

6. Projectile according to claim 5, wherein said retaining means comprise a peg fastened to said finger.

7. Projectile according to claim 1, wherein said abutment means further comprises clockwork-type rotation regulating means operative at least with said mobile member in said safe position and positions in the immediate vicinity of said safe position and means coupling said rotation regulating means to said mobile member.

8. Projectile according to claim 7, wherein said mobile member is disengaged from said rotation regulating means in said armed position and positions in the immediate vicinity of said armed position.

9. Projectile according to claim 7, wherein said retaining means for holding said mobile member in said safe position consist in means for disabling said rotation regulating means.

10. Projectile comprising a pyrotechnic charge, a mobile member in said projectile adapted to rotate between a safe position and an armed position, a passage in said mobile member, a pyrotechnic delay device at least part of which is accommodated in said passage and means for initiating said pyrotechnic charge via said pyrotechnic delay device, said passage being oriented so as to isolate functionally said pyrotechnic delay device from said pyrotechnic charge when said mobile member is in said safe position and to couple functionally said pyrotechnic delay device to said pyrotechnic charge when said mobile member is in said armed position, said projectile further comprising means on said mobile member and on said projectile to guide relative rotation between them about an axis fixed relative to said mobile member and relative to said projectile and mechanical arming means adapted to retain said mobile member in said safe position and against rotation about said axis relative to said projectile at least until said projectile is fired and to oblige said mobile member to move to said armed position when said projectile is fired by rotating about said axis relative to said projectile, fuse means and wherein said passage has a first branch on said axis and a second branch substantially perpendicular to said axis, said first branch is functionally coupled to said fuse means and said second branch is functionally coupled to said pyrotechnic charge in said armed position and functionally isolated from said pyrotechnic charge in said safe position.

11. Projectile according to claim 10, wherein said pyrotechnic charge comprises two operational charges in diametrally opposed positions relative to said axis and said second branch passes through said mobile member perpendicularly to said axis, perpendicularly to the diametral alignment of said operational charges in said safe position and parallel to the diametral alignment of said operational charges in said armed position.

12. Projectile according to claim 10, wherein said pyrotechnic charge comprises two operational charges in diametrally opposed positions relative to said axis and said second branch passes through said mobile member perpendicularly to said axis, perpendicularly to the diametral alignment of said operational charges in said safe position and parallel to the diametral alignment of said operational charges in said armed position and said means for initiating are accommodated in said second branch.

13. Projectile according to claim 10, wherein said pyrotechnic charge comprises two operational charges in diametrally opposed positions relative to said axis and said second branch passes through said mobile member perpendicularly to said axis, perpendicularly to the diametral alignment of said operational charges in said safe position and parallel to the diametral alignment of said operational charges in said armed position, said pyrotechnic charge is offset relative to said axis in said longitudinal direction and said second branch is transversely oriented in said safe position and longitudinally oriented in said armed position and said means for initiating are accommodated in said second branch.

14. Projectile comprising a pyrotechnic charge, a mobile member in said projectile adapted to rotate between a safe position and an armed position, a passage in said mobile member, a pyrotechnic delay device at least part of which is accommodated in said passage and means for initiating said pyrotechnic charge via said pyrotechnic delay device, said passage being oriented so as to isolate functionally said pyrotechnic delay device from said pyrotechnic charge when said mobile member is in said safe position and to couple functionally said pyrotechnic delay device to said pyrotechnic charge when said mobile member is in said armed position, said projectile further comprising means on said mobile member and on said projectile to guide relative rotation between them about an axis fixed relative to said mobile member and relative to said projectile and mechanical arming means adapted to retain said mobile member in said safe position and against rotation about said axis relative to said projectile at least until said projectile is fired and to oblige said mobile member to move to said armed position when said projectile is fired by rotating about said axis relative to said projectile, said axis being transverse to a longitudinal direction in which said projectile is fired, fuse means and wherein said passage has a first branch on said axis and a second branch substantially perpendicular to said axis, said first branch is functionally coupled to said fuse means and said second branch is functionally coupled to said pyrotechnic charge in said armed position and functionally isolated from said pyrotechnic charge in said safe position, said pyrotechnic charge is offset relative to said axis in said longitudinal direction and said second branch is transversely oriented in said safe position and longitudinally oriented in said armed position.

15. Projectile comprising a pyrotechnic charge, a mobile member in said projectile adapted to rotate between a safe position and an armed position, a passage in said mobile member, a pyrotechnic delay device at least part of which is accommodated in said passage and means for initiating said pyrotechnic charge via said pyrotechnic delay device, said passage being oriented so as to isolate functionally said pyrotechnic delay device from said pyrotechnic charge when said mobile member is in said safe position and to couple functionally said pyrotechnic delay device to said pyrotechnic charge when said mobile member is in said armed position, said projectile further comprising means on said mobile member and on said projectile to guide relative rotation between them about an axis fixed relative to said mobile member and relative to said projectile and mechanical arming means adapted to retain said mobile member in said safe position and against rotation about said axis relative to said projectile at least until said projectile is fired and to oblige said mobile member to move to said armed position when said projectile is fired by rotating about said axis relative to said projectile, said axis being transverse to a longitudinal direction in which said projectile is fired, two operational charges in diametrally opposed positions relative to said axis and said second branch passes through said mobile member perpendicularly to said axis, perpendicularly to the dimetral alignment of said operational charges in said safe position and parallel to the diametral alignment of said operational charges in said armed position, said pyrotechnic charge is offset relative to said axis in said longitudinal direction and said second branch is transversely oriented in said safe position and longitudinally oriented in said armed position.

16. Projectile comprising a pyrotechnic charge, a mobile member in said projectile adapted to rotate between a safe position and an armed position, a passage in said mobile member, a pyrotechnic delay device at least part of which is accommodated in said passage and means for initiating said pyrotechnic charge via said pyrotechnic delay device, said passage being oriented so as to isolate functionally said pyrotechnic delay device from said pyrotechnic charge when said mobile member is in said safe position and to couple functionally said pyrotechnic delay device to said pyrotechnic charge when said mobile member is in said armed position, said projectile further comprising means on said mobile member and on said projectile to guide relative rotation between them about an axis fixed relative to said mobile member and relative to said projectile and mechanical arming means adapted to retain said mobile member in said safe position and against rotation about said axis relative to said projectile at least until said projectile is fired and to oblige said mobile member to move to said armed position when said projectile is fired by rotating about said axis relative to said projectile, fuse means and wherein said passage has a first branch on said axis and a second branch substantially perpendicular to said axis, said first branch is functionally coupled to said fuse means and said second branch is functionally coupled to said pyrotechnic charge in said armed position and functionally isolated from said pyrotechnic charge in said safe position and said means for initiating are accommodated in said second branch.

17. Projectile comprising a pyrotechnic charge, a mobile member in said projectile adapted to rotate between a safe position and an armed position, a passage in said mobile member, a pyrotechnic delay device at least part of which is accommodated in said passage and means for initiating said pyrotechnic charge via said pyrotechnic delay device, said passage being oriented so as to isolate functionally said pyrotechnic delay device from said pyrotechnic charge when said mobile member is in said safe position and to couple functionally said pyrotechnic delay device to said pyrotechnic charge when said mobile member is in said armed position, said projectile further comprising means on said mobile member and on said projectile to guide relative rotation between them about an axis fixed relative to said mobile member and relative to said projectile and mechanical arming means adapted to retain said mobile member in said safe position and against rotation about said axis relative to said projectile at least until said projectile is fired and to oblige said mobile member to move to said armed position when said projectile is fired by rotating about said axis relative to said projectile, said axis being transverse to a longitudinal direction in which said projectile is fired, fuse means and wherein said passage has a first branch on said axis and a second branch substantially perpendicular to said axis, said first branch is functionally coupled to said fuse means and said second branch is functionally coupled to said pyrotechnic charge in said armed position and functionally isolated from said pyrotechnic charge in said safe position, said pyrotechnic charge is offset relative to said axis in said longitudinal direction and said second branch is transversely oriented in said safe position and longitudinally oriented in said armed position and said means for initiating are accommodated in said second branch.

* * * * *